US012320561B2

(12) United States Patent
Chen et al.

(10) Patent No.: US 12,320,561 B2
(45) Date of Patent: Jun. 3, 2025

(54) HVAC UNIT WITH EXPANSION DEVICE

(71) Applicant: Carrier Corporation, Palm Beach Gardens, FL (US)

(72) Inventors: Cheng Chen, Avon, IN (US); Larry D. Burns, Avon, IN (US)

(73) Assignee: Carrier Corporation, Palm Beach Gardens, FL (US)

( * ) Notice: Subject to any disclaimer, the term of this patent is extended or adjusted under 35 U.S.C. 154(b) by 306 days.

(21) Appl. No.: 17/255,249

(22) PCT Filed: Sep. 9, 2020

(86) PCT No.: PCT/US2020/049823

§ 371 (c)(1),
(2) Date: Dec. 22, 2020

(87) PCT Pub. No.: WO2021/050468

PCT Pub. Date: Mar. 18, 2021

(65) Prior Publication Data

US 2022/0042727 A1 Feb. 10, 2022

Related U.S. Application Data

(60) Provisional application No. 62/899,798, filed on Sep. 13, 2019.

(51) Int. Cl.
*F25B 41/22* (2021.01)
*F25B 5/02* (2006.01)

(52) U.S. Cl.
CPC ..... *F25B 41/22* (2021.01); *F25B 5/02* (2013.01); *F25B 2600/02* (2013.01); *F25B 2600/2513* (2013.01)

(58) Field of Classification Search
CPC .. F25B 5/02; F25B 41/20; F25B 41/22; F25B 41/24; F25B 2600/02; F25B 2600/2513; F25B 2600/2519
See application file for complete search history.

(56) References Cited

U.S. PATENT DOCUMENTS 3,427,819 A * 2/1969 Seghetti ..... F25B 40/02 62/509
5,822,996 A * 10/1998 Sienel ..... F25B 9/006 62/502

(Continued)

FOREIGN PATENT DOCUMENTS

JP H09126595 5/1997
JP 6828790 B1 * 2/2021 ..... F25B 13/00

(Continued)

OTHER PUBLICATIONS

International Search Report & Written Opinion for International Application No. PCT?US020/049283 mailing date of Dec. 14, 2020.

(Continued)

*Primary Examiner* — Miguel A Diaz
(74) *Attorney, Agent, or Firm* — Carlson, Gaskey & Olds, P.C.

(57) ABSTRACT

An outdoor HVAC unit includes a housing. A compressor is located within the housing. A heat exchanger is located within the housing and is in fluid communication with the compressor. At least one expansion device is located within the housing and is in fluid communication with the heat exchanger.

19 Claims, 1 Drawing Sheet

(56) References Cited

U.S. PATENT DOCUMENTS

| | | | | | |
|---|---|---|---|---|---|
| 5,848,537 | A * | 12/1998 | Biancardi | F25B 13/00 | 62/324.6 |
| 6,070,420 | A * | 6/2000 | Biancardi | F25B 9/006 | 62/502 |
| 6,615,597 | B1 * | 9/2003 | Domyo | F25B 13/00 | 62/509 |
| 10,775,082 | B2 * | 9/2020 | Tanaka | F25B 41/20 | |
| 11,313,568 | B2 * | 4/2022 | Yamada | F24F 1/14 | |
| 2004/0144111 | A1 * | 7/2004 | Matsuoka | F25B 41/22 | 62/193 |
| 2019/0056158 | A1 * | 2/2019 | Horiba | F25B 39/028 | |
| 2019/0170382 | A1 | 6/2019 | Weinert | | |
| 2019/0203989 | A1 * | 7/2019 | Tanaka | F25B 41/24 | |
| 2019/0226707 | A1 | 7/2019 | Oka | | |
| 2019/0331377 | A1 * | 10/2019 | Matsuda | F25B 5/02 | |
| 2019/0383533 | A1 * | 12/2019 | Ochiai | F25B 41/20 | |
| 2021/0199349 | A1 * | 7/2021 | Lee | F25B 5/02 | |
| 2021/0302073 | A1 * | 9/2021 | Taras | F25B 13/00 | |
| 2021/0341192 | A1 * | 11/2021 | Matsusaka | F25B 5/02 | |
| 2021/0364208 | A1 * | 11/2021 | Taras | F25B 41/31 | |
| 2022/0082304 | A1 * | 3/2022 | Welch | F25B 5/02 | |
| 2022/0178597 | A1 * | 6/2022 | Sim | F25B 41/325 | |

FOREIGN PATENT DOCUMENTS

| | | | | |
|---|---|---|---|---|
| WO | WO-0246664 | A1 * | 6/2002 | F25B 13/00 |
| WO | WO-2015133398 | A1 * | 9/2015 | F25B 41/04 |
| WO | WO-2018236021 | A1 * | 12/2018 | F24F 1/32 |
| WO | WO-2021106793 | A1 * | 6/2021 | F25B 13/00 |

OTHER PUBLICATIONS

International Preliminary Report on Patentability for International Application No. PCT/US2020/049823 dated Mar. 24, 2022.

* cited by examiner

HVAC UNIT WITH EXPANSION DEVICE

CROSS-REFERENCE TO RELATED APPLICATIONS

This application claims priority to U.S. Provisional Application No. 62/899,798, which was filed on Sep. 13, 2019 and is incorporated herein by reference.

BACKGROUND

The present disclosure relates to refrigeration systems and, more particularly, to refrigeration systems with at least one indoor unit and at least one outdoor unit.

Buildings, such as university buildings, office buildings, residential buildings, commercial buildings, and the like, include climate systems which are operable to control the climate inside the building. A typical climate system includes an evaporator, a compressor, a condenser, and an expansion valve. These components utilize a refrigerant to maintain an indoor temperature of the buildings at a desired level.

SUMMARY

In one exemplary embodiment, an outdoor HVAC unit includes a housing. A compressor is located within the housing. A heat exchanger is located within the housing and is in fluid communication with the compressor. At least one expansion device is located within the housing and is in fluid communication with the heat exchanger.

In a further embodiment of any of the above, at least one isolation valve is in fluid communication with the compressor.

In a further embodiment of any of the above, the isolation value is fluidly upstream of the compressor. The at least one expansion device is fluidly downstream of the heat exchanger.

In a further embodiment of any of the above, the heat exchanger is a condenser.

In a further embodiment of any of the above, the at least one expansion device includes a plurality of expansion devices each in fluid communication with the heat exchanger.

In a further embodiment of any of the above, a plurality of liquid refrigerant lines are in fluid communication with the heat exchanger and a corresponding one of the plurality of expansion devices.

In a further embodiment of any of the above, the plurality of liquid lines are located within the housing.

In a further embodiment of any of the above, the outdoor unit operates with an A2L refrigerant.

In another exemplary embodiment, a refrigeration system includes an outdoor housing. A compressor is located within the outdoor housing. A first heat exchanger is located within the outdoor housing and is in fluid communication with the compressor. At least one expansion device is located within the outdoor housing and is in fluid communication with the heat exchanger. At least one second heat exchanger is located fluidly between the at least one expansion device and the compressor.

In a further embodiment of any of the above, the second heat exchanger is located within an indoor unit.

In a further embodiment of any of the above, at least one flow modulating valve is located fluidly between the at least one expansion device and the second heat exchanger.

In a further embodiment of any of the above, the first heat exchanger is a condenser. The second heat exchanger is an evaporator.

In a further embodiment of any of the above, a controller is configured to control the at least one modulating value, the at least one expansion device, and the compressor in response to a desired conditioning request.

In a further embodiment of any of the above, at least one isolation valve is located within the outdoor housing and fluidly between the at least one second heat exchanger and the compressor.

In a further embodiment of any of the above, a first fan is located adjacent the first heat exchanger and at least one second fan is located adjacent the at least one second heat exchanger.

In a further embodiment of any of the above, a plurality of liquid refrigerant lines are in fluid communication with the heat exchanger and a corresponding one of the at least one expansion devices.

In a further embodiment of any of the above, the refrigeration system operates with an A2L refrigerant.

In another exemplary embodiment, a method of operating a refrigeration system includes the step of fluidly isolating a first heat exchanger located within a housing of an outdoor unit from an indoor unit with at least one expansion device located within the outdoor unit. A second heat exchanger is fluidly isolated in the indoor unit from a compressor with at least on isolation valve located within the outdoor unit.

In a further embodiment of any of the above, at least one liquid refrigerant line extends from the first heat exchanger to the at least one expansion device. The at least one liquid refrigerant line is located within the housing of the outdoor unit.

In a further embodiment of any of the above, the refrigeration system operates with an A2L refrigerant.

DETAILED DESCRIPTION

Figure 1:
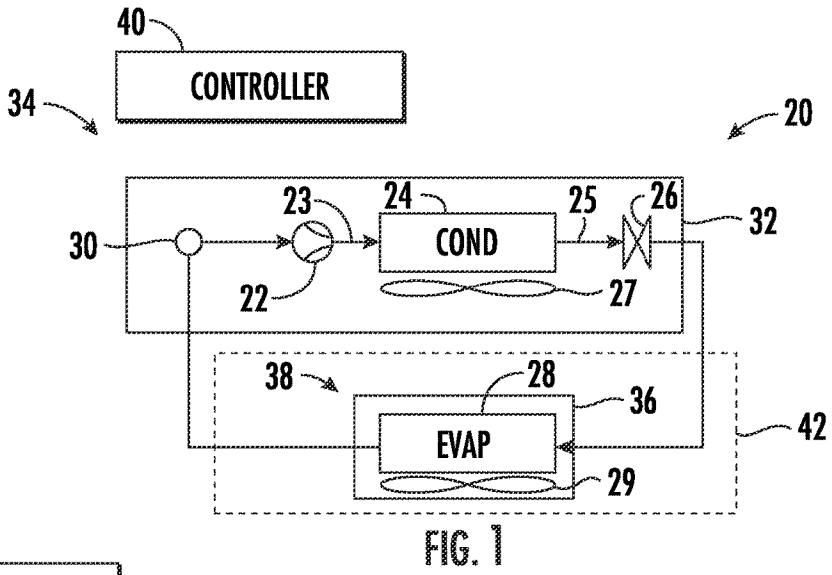
FIG. 1 illustrates an example refrigeration system.

A refrigeration system 20 is illustrated in FIG. 1 and includes a compressor 22 delivering refrigerant into a discharge line 23 leading to a heat exchanger 24, such as a condenser for subcritical applications and a gas cooler for trans-critical applications. The heat is transferred in the heat exchanger 24 from the refrigerant to a secondary loop fluid, such as ambient air, with a fan 27. The high pressure, but cooled, refrigerant passes into a liquid refrigerant line 25 downstream of the heat exchanger 24 and through an expansion device 26, where the refrigerant is expanded to a lower pressure and temperature. Downstream of the expansion device 26, the refrigerant flows through an evaporator 28 and then through an isolation valve 30 before returning back to the compressor 22. A fan 29 draws air to be conditioned through the evaporator 28.

In the illustrated example, the compressor 22, condenser 24, expansion device 26, and isolation valve 30 are located within a housing 32 to form an outdoor unit 34. The expansion device 26 could include one of a TXV, a piston valve, or an EXV. Similarly, the evaporator 28 and the fan 29 are located in a housing 36 that forms an indoor unit 38. Furthermore, the system 20 is configured to operate with an A2L refrigerant.

The configuration of FIG. 1 can be used in a number of applications, such as in residential systems. When used with a residential system, the evaporator 28 is located inside a residence and the fan 29 draws air through the evaporator 28. Additionally, the fan 29 may be associated with a separate heating system for the residence. A controller 40 is either in direct electrical communication or wireless communication with the compressor 22, the fans 27, 29, the expansion device 26, and the isolation valve 30 to control or monitor operation of these elements. The controller 40 includes a microprocessor in communication with memory which stores programs to direct operation of the refrigeration system 20.

In the event of a refrigerant leak within the refrigeration system 20, the controller 40 can isolate refrigerant in the outdoor unit 34 from the indoor unit 38 by signaling the compressor 22 to stop along with signaling the isolation valve 30 and the expansion device 26 to move into a fully closed position that prevents the passage of refrigerant. One feature of this isolation approach with the outdoor unit 34 is that a greater percentage of refrigerant of the entire system 20 is captured in the outdoor unit 34. In particular, a greater percentage is captured because the liquid refrigerant line 25 does not extend downstream of the outdoor unit 34 since the expansion device 26 is located within the housing 32. This is due to the amount of refrigerant located in the liquid refrigerant line 25 being much greater per unit length than the amount of refrigerant in the refrigerant line connecting the expansion device 26 with the evaporator 28.

Figure 2:
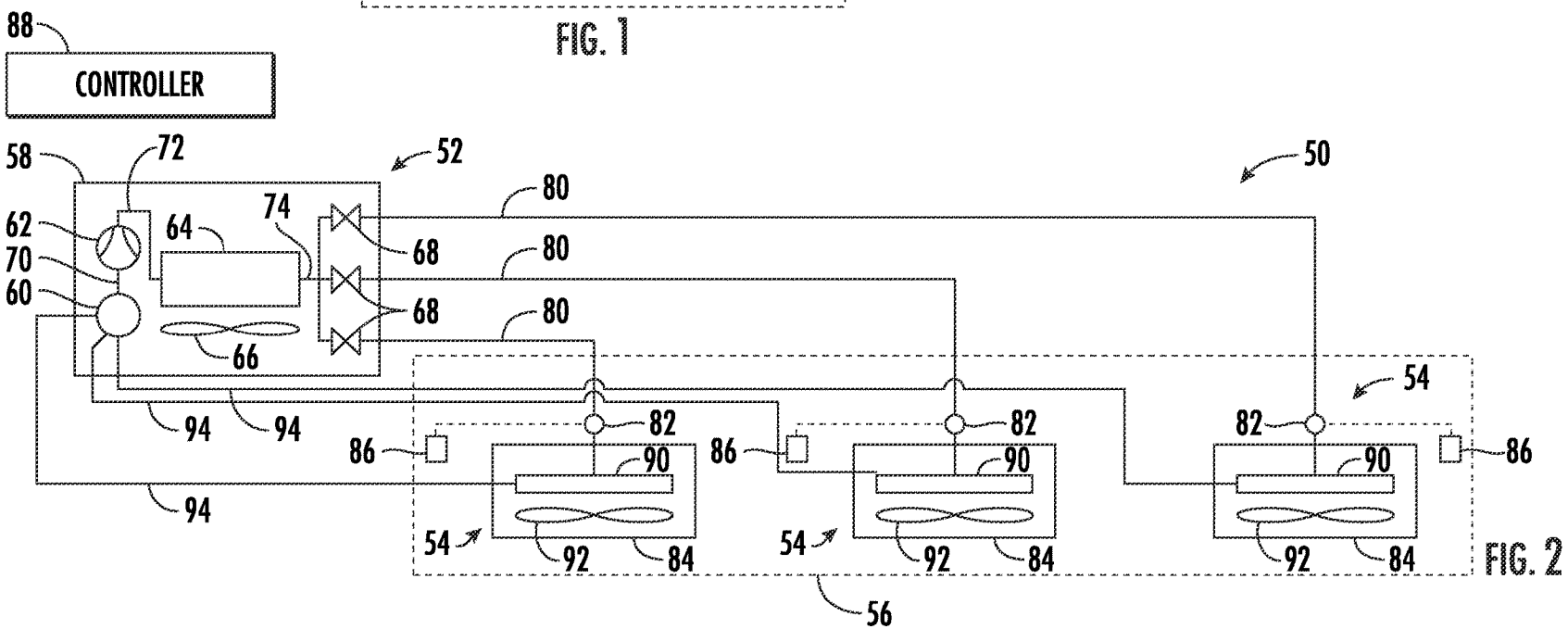
FIG. 2 illustrates an example multi-zone refrigeration system.

FIG. 2 illustrates example variable refrigerant flow ("VRF") system 50. In the illustrated example, the VRF system 50 includes a single outdoor unit 52 and multiple indoor units 54. The outdoor unit 52 is located on an exterior of a building 56 while the indoor units 54 are located on an interior of the building 56. Although the VRF system 50 only includes a single outdoor unit 52 in the illustrated example, the VRF system 50 could include multiple outdoor units 52 arranged in series depending on the heating and/or cooling needs of the building 56. Additionally, the VRF system 50 is configured to operate with an A2L refrigerant.

In the illustrated example, the outdoor unit 52 includes a housing 58 enclosing an isolation valve 60, a compressor 62, a first heat exchanger 64, a fan 66, and multiple expansion devices 68. The compressor 62 is in fluid communication with a suction line 70 that connects the compressor 62 with an outlet of the isolation valve 60. Additionally, the compressor 62 is in fluid communication with a discharge line 72 that connects the compressor 62 with the first heat exchanger 64. A liquid refrigerant line 74 connects an output of the first heat exchanger 64 with each of the three expansion devices 68, such that the liquid refrigerant line 74 includes a branching portion between the first heat exchanger 64 and each of the expansion devices 68.

In the illustrated example, the expansion devices 68 could include one of a TXV, a piston valve, or an EXV. An output of each of the expansion devices 68 is in fluid communication with an input line 80 that connects each of the expansion devices 68 with one of the indoor units 54. One feature of having the liquid refrigerant line 74 located within the housing 58 is that the overall system refrigerant charge is reduced due to the reduction in length of the liquid refrigerant line 74. This is due to the amount of refrigerant located in the liquid refrigerant line 74 being much greater per unit length than the amount of refrigerant in a corresponding one of the input lines 80.

Each of the input lines 80 are in communication with a flow modulating valve 82 associated with each of the indoor units 54. Although the flow modulating valves 82 are shown on an exterior of the indoor units 54, the flow modulating valves 82 could be located within a housing 84 of the indoor units 54. The flow modulating valves 82 are in electrical communication with individual temperature controls 86 to control a conditioned temperature of a region within the building 56. To change the temperature in the corresponding region of the building 56, the indoor units 54 each include a second heat exchanger 90 and a second fan 92 to move air within the building 56 over the second heat exchanger 90.

Return lines 94 fluidly connect the second heat exchangers 90 in the indoor units 54 with the isolation valve 60 in the outdoor unit 52. Although the isolation valve 60 is shown receiving each of the three return lines 94 in the illustrated example, an additional valve could be utilized to collect each of the return lines 94 into a single return line which would be in fluid communication with an input on the isolation valve 60.

During operation of the VRF system 50, the individual temperature controls 86 are used to control a temperature within the regions of the building 56. To change the temperature, the individual temperature controls 86 can communicate with the individual flow modulating valves 82 for each of the associated indoor units 54. Alternatively, the individual temperature controls 86 can communication with the rest of the VRF system 50 through a main controller 88. The main controller 88 controls and monitors operation of the isolation valve 60, the compressor 62, the fans 66 and 92, the expansion devices 68, and/or the flow modulating valves 82. The controller 88 includes a microprocessor in communication with memory which stores programs to direct operation of the VRF system 50.

Furthermore, in the event of a refrigerant leak within the VRF system 50, the main controller 88 can isolate refrigerant in the outdoor unit 52 from the rest of the indoor units 54 by signaling the compressor 62 to stop along with signaling the isolation valve 60 and each of the expansion devices 68 to move into a fully closed position that prevents the passage of refrigerant. One feature of this isolation approach with the outdoor unit 52 is that a greater percentage of refrigerant of the entire VRF system 50 is able to be captured in the outdoor unit 52. In particular, a greater percentage is captured because the liquid refrigerant lines 74 do not extend downstream of the outdoor unit 52 since the expansion devices 68 are located within the housing 58.

Although the different non-limiting examples are illustrated as having specific components, the examples of this disclosure are not limited to those particular combinations. It is possible to use some of the components or features from any of the non-limiting examples in combination with features or components from any of the other non-limiting examples.

It should be understood that like reference numerals identify corresponding or similar elements throughout the several drawings. It should also be understood that although a particular component arrangement is disclosed and illustrated in these exemplary embodiments, other arrangements could also benefit from the teachings of this disclosure.

The foregoing description shall be interpreted as illustrative and not in any limiting sense. A worker of ordinary skill in the art would understand that certain modifications could come within the scope of this disclosure. For these reasons, the following claim should be studied to determine the true scope and content of this disclosure.

What is claimed is:

1. An outdoor HVAC unit comprising:

a housing;

an isolation valve located within the housing, wherein the isolation valve is configured to be in fluid communication with a plurality of return lines each configured to communicate gaseous refrigerant flow from a respective evaporator of a respective indoor unit;

a compressor located within the housing and in fluid communication with the isolation valve;

a condenser located within the housing and in fluid communication with the compressor;

at least one expansion device located within the housing and in fluid communication with the condenser;

a controller configured to, in the event of a refrigerant leak, instruct the compressor to stop and instruct the isolation valve and the at least one expansion device to each move into a fully closed position, wherein moving the isolation valve into a fully closed position fluidly isolates all of the plurality of return lines from the compressor; and wherein the compressor is located directly between the isolation valve and the condenser, such that, in operation, fluid flow within the housing from the isolation valve to the condenser passes through the compressor.

2. The unit of claim 1, wherein the isolation valve is fluidly upstream of the compressor and the at least one expansion device is fluidly downstream of the heat exchanger.

3. The unit of claim 1, wherein the outdoor unit operates with an A2L refrigerant.

4. The unit of claim 1, wherein the at least one expansion device comprises a plurality of expansion devices each in direct fluid communication with the condenser.

5. The unit of claim 4, further comprising a plurality of liquid refrigerant lines in fluid communication with the condenser and a corresponding one of the plurality of expansion devices.

6. A refrigeration system comprising:

an outdoor housing;

an isolation valve located within the outdoor housing;

a compressor located within the outdoor housing and in fluid communication with the isolation valve;

a condenser located within the outdoor housing and in fluid communication with the compressor;

at least one expansion device located within the outdoor housing and in fluid communication with the condenser;

a plurality of indoor units each including an evaporator, wherein each evaporator is located fluidly between the at least one expansion device and the isolation valve, wherein the isolation valve is in fluid communication with a plurality of return lines each configured to communicate gaseous refrigerant flow from the evaporator of one of the plurality of indoor units;

a controller configured to, in the event of a refrigerant leak, instruct the compressor to stop and instruct the isolation valve and the at least one expansion device to each move into a fully closed position, wherein moving the isolation valve into a fully closed position fluidly isolates all of the plurality of return lines from the compressor; and wherein the compressor is located directly between the isolation valve and the condenser, such that, in operation, fluid flow within the outdoor housing from the isolation valve to the condenser passes through the compressor.

7. The system of claim 6, further comprising a first fan located adjacent the condenser and at least one second fan located adjacent the evaporator of one of the plurality of indoor units.

8. The system of claim 6, further comprising at least one flow modulating valve located fluidly between the at least one expansion device and the evaporator of one of the plurality of indoor units.

9. The system of claim 8, wherein the controller is further configured to control the at least one modulating valve, the at least one expansion device, and the compressor in response to a desired conditioning request.

10. The system of claim 6, wherein the at least one expansion device comprises a plurality of expansion devices, wherein each of the plurality of expansion devices communicates with a respective evaporator of one of the plurality of indoor units.

11. The system of claim 10, further comprising a liquid refrigerant line extending from the condenser, the liquid refrigerant line including branching portions extending to each of the plurality of expansion devices to place the condenser in direct fluid communication with each of the plurality of expansion devices.

12. The system of claim 10, wherein a plurality of input lines each place one of the plurality of expansion devices in fluid communication with the evaporator of one of the plurality of indoor units.

13. The system of claim 12, further comprising:

a plurality of flow modulating valves each in fluid communication with a respective one of the plurality of input lines and associated with a respective one of the indoor units; and wherein the controller is further configured to control the plurality of modulating valves, the plurality of expansion devices, and the compressor in response to a desired conditioning request.

14. A method of operating a refrigeration system comprising the steps of:

fluidly isolating a heat exchanger located within a housing of an outdoor unit from a plurality of indoor units by moving at least one expansion device located within the outdoor unit into a fully closed position;

fluidly isolating a plurality of return lines from the plurality of indoor units from a compressor located within the outdoor unit with a single isolation valve located within the outdoor unit;

wherein the compressor is located directly between the isolation valve and the heat exchanger, such that, in operation, fluid flow within the outdoor unit from the isolation valve to the heat exchanger passes through the compressor.

15. The method of claim 14, wherein at least one liquid refrigerant line extends from the heat exchanger to the at least one expansion device and the at least one liquid refrigerant line is located within the housing of the outdoor unit.

16. The method of claim 14, wherein the refrigeration system operates with an A2L refrigerant.

17. The method of claim 14, wherein the at least one expansion device comprises a plurality of expansion devices, each of the plurality of expansion devices in fluid communication with a respective one of the plurality of indoor units.

18. The method of claim 14, wherein:

the heat exchanger comprises a condenser; and wherein the plurality of return lines are each configured to communicate gaseous refrigerant flow from a respective evaporator of a respective one of the plurality of indoor units.

19. The method of claim 18, wherein moving the at least one expansion device into a fully closed position fluidly isolates the condenser of the outdoor unit from the evaporators of the plurality of indoor units.

* * * * *